US007567764B2

(12) United States Patent
Yamanaka et al.

(10) Patent No.: US 7,567,764 B2
(45) Date of Patent: Jul. 28, 2009

(54) DEVELOPING DEVICE HAVING THICKNESS REGULATING MEMBER AND IMAGE FORMING APPARATUS

(75) Inventors: Takayuki Yamanaka, Nara (JP); Yuichi Kazaki, Kashiba (JP); Eiichi Kido, Yamatokoriyama (JP); Atsushi Inoue, Nara (JP); Hiroaki Nakaya, Osakasayama (JP)

(73) Assignee: Sharp Kabushiki Kaisha, Osaka-shi (JP)

( * ) Notice: Subject to any disclaimer, the term of this patent is extended or adjusted under 35 U.S.C. 154(b) by 126 days.

(21) Appl. No.: 11/700,783

(22) Filed: Feb. 1, 2007

(65) Prior Publication Data

US 2007/0177906 A1 Aug. 2, 2007

(30) Foreign Application Priority Data

Feb. 2, 2006 (JP) ..... 2006-026328

(51) Int. Cl.
*G03G 15/08* (2006.01)

(52) U.S. Cl. ..... 399/53; 399/71; 399/284

(58) Field of Classification Search ..... 399/53, 399/43, 71, 284, 274, 279, 265
See application file for complete search history.

(56) References Cited

U.S. PATENT DOCUMENTS

| | | | | | |
|---|---|---|---|---|---|
| 4,748,472 | A | * | 5/1988 | Mukai et al. | 399/284 X |
| 5,297,490 | A | * | 3/1994 | Schneider et al. | 101/365 |
| 5,416,568 | A | * | 5/1995 | Yoshiki et al. | 399/285 |
| 5,960,239 | A | * | 9/1999 | Toyoshima et al. | 399/284 |
| 2007/0110482 | A1 | * | 5/2007 | Kazaki et al. | 399/279 |

FOREIGN PATENT DOCUMENTS

| | | | | |
|---|---|---|---|---|
| JP | 58-059482 | A | * | 4/1983 |
| JP | 59-71069 | A | | 4/1984 |
| JP | 60-241066 | A | * | 11/1985 |
| JP | 61-243473 | A | | 10/1986 |
| JP | 4-281478 | A | | 10/1992 |
| JP | 6-083172 | A | | 3/1994 |
| JP | 10-323971 | A | * | 12/1998 |
| JP | 11-95546 | A | | 4/1999 |
| JP | 2001-356589 | A | | 12/2001 |
| JP | 2003-280389 | A | | 10/2003 |

OTHER PUBLICATIONS

Machine translation of JP 10-323971 A dated Jul. 30, 2008.*

* cited by examiner

*Primary Examiner*—Sophia S Chen
(74) *Attorney, Agent, or Firm*—Birch, Stewart, Kolasch & Birch, LLP

(57) ABSTRACT

An developing device in which a developing roller develops an electrostatic latent image on a photo conductor; a developing roller driving unit rotates the developing roller in a forward direction and in a backward direction respectively while development is performed and not performed; a thickness regulating member, which is pressed against a surface of the developing roller, regulates a thickness of developer adhered to the surface of the developing roller; and a suppression unit suppresses a pressing force of the thickness regulating member when the developing roller is rotating in the backward direction.

12 Claims, 12 Drawing Sheets

FIG. 3

| | PRINTING MODE | ROTATION CONTROL |
|---|---|---|
| UNDER DEVELOPING | CARD BOARD | ROTATE FORWARD AT LOW SPEED |
| | COLOR | ROTATE FORWARD AT MEDIUM SPEED |
| | MONOCHROME | ROTATE FORWARD AT HIGH SPEED |
| NOT UNDER DEVELOPING | —— | ROTATE BACKWARD AT LOW SPEED |

FIG. 4

| RUNNING DISTANCE OF DEVELOPING ROLLER (mm) | 0~ 1500000 | 1500000~ 3000000 | 3000000~ 4500000 | 4500000~ 6000000 | 6000000~ |
|---|---|---|---|---|---|
| THE CUMULATIVE NUMBER OF REVOLUTIONS (K ROTATIONS) | 0~30 | 30~60 | 60~90 | 90~120 | 120~ |
| THE NUMBER OF A4 SINGLE PRINTS (K SHEETS) | 0~2 | 2~4 | 4~6 | 6~8 | 8~ |
| THE AMOUNT OF BACKWARD ROTATION | 0.5mm (3.58°) | 1.0mm (7.46°) | 1.5mm (10.74°) | 2.0mm (14.32°) | 2.5mm (17.90°) |

FIG. 5

| RUNNING DISTANCE OF DEVELOPING ROLLER (mm) | 0~ 1500000 | 1500000~ 3000000 | 3000000~ 4500000 | 4500000~ 6000000 | 6000000~ |
|---|---|---|---|---|---|
| THE CUMULATIVE NUMBER OF REVOLUTIONS (K ROTATIONS) | 0~30 | 30~60 | 60~90 | 90~120 | 120~ |
| THE NUMBER OF A4 SINGLE PRINTS (K SHEETS) | 0~2 | 2~4 | 4~6 | 6~8 | 8~ |
| FREQUENCY OF BACKWARD ROTATION | ONLY AFTER WARMING UP | AFTER WARMING UP AND EVERY TIME TEN JOBS ARE MADE | AFTER WARMING UP AND EVERY TIME FIVE JOBS ARE MADE | AFTER WARMING UP AND EVERY TIME TWO JOBS ARE MADE | AFTER WARMING UP AND ONE JOB IS MADE |

FIG. 6

| RUNNING DISTANCE OF DEVELOPING ROLLER/ THE NUMBER OF A4 PRINTS | SMALLER THAN 428 | EQUAL TO OR LARGER THAN 428 AND SMALLER THAN 856 | EQUAL TO OR LARGER THAN 856 AND SMALLER THAN 1131 | EQUAL TO OR LARGER THAN 1131 AND SMALLER THAN 1498 | EQUAL TO OR LARGER THAN 1498 |
|---|---|---|---|---|---|
| EQUIVALENT OF THE NUMBER OF A4 INTERMISSION SHEETS | LARGER THAN 3 | 1~3 | 0.7~1 | 0.5~0.7 | EQUAL TO OR SMALLER THAN 0.5 |
| FREQUENCY OF BACKWARD ROTATION | NOTHING | AFTER WARMING UP AND EVERY TIME TEN JOBS ARE MADE | AFTER WARMING UP AND EVERY TIME FIVE JOBS ARE MADE | AFTER WARMING UP AND EVERY TIME TWO JOBS ARE MADE | AFTER WARMING UP AND ONE JOB IS MADE |

DEVELOPING DEVICE HAVING THICKNESS REGULATING MEMBER AND IMAGE FORMING APPARATUS

CROSS-REFERENCE TO RELATED APPLICATIONS

This Nonprovisional application claims priority under 35 U.S.C. §119(a) on Patent Application No. 2006-026328 filed in Japan on Feb. 2, 2006, the entire contents of which are hereby incorporated by reference.

BACKGROUND OF THE INVENTION

1. Field of the Invention

The present invention relates to: a developing device which comprises a developing roller and a thickness regulating member that is pressed against the surface of the developing roller so as to regulate the thickness of developer adhered to the surface of the developing roller; and an image forming apparatus comprising the developing device.

2. Description of Related Art

An image forming apparatus for which the electrographic method is employed, such as a laser printer, a digital copying machine, a facsimile or a complex machine, forms an image by electrostatically adsorbing toner adhered to the surface of a developing roller to an electrostatic latent image formed on the surface of a photo conductor so as to develop the electrostatic latent image and transferring the developed electrostatic latent image to recording paper.

Since it is necessary to equalize the amount of toner to be supplied to a development area (development position), where the photo conductor and the developing roller come close, in order to keep high quality of an image to be formed, a doctor blade for regulating the thickness of toner adhered to the surface of the developing roller is pressed against the surface of the developing roller. By rotating the developing roller in a predetermined direction, a redundancy of toner adhered to the surface of the developing roller is scraped off by the doctor blade and a toner layer having a uniform thickness is formed on the surface of the developing roller and is supplied to the development area.

In the structure wherein the doctor blade is pressed against the surface of the developing roller, however, pressure is sometimes applied to toner when toner enters the space between the surface of the developing roller and the doctor blade, and cohesion of toner which is melted by frictional heat sometimes produces a mass of toner. Therefore, there is a problem that development cannot be achieved in a part where a mass of toner enters and toner is not supplied onto the photo conductor, and a white vertical line appears on the formed image. Suggested in order to solve the above problem is a developing device for rotating a developing roller in the backward direction while development is not performed so as to remove toner which has entered the space between the surface of the developing roller and the doctor blade (see Japanese Patent Application Laid-Open No. 61-243473 and Japanese Patent Application Laid-Open No. 4-281478).

Moreover, suggested as a developing device for rotating a developing roller backward is a developing device which rotates the developing roller in the backward direction by a predetermined angle without applying bias voltage having AC component while image formation is not performed and idles the developing roller in the same direction as that for image formation after the rotation in the backward direction, so as to charge toner (see Japanese Patent Application Laid-Open No. 2003-280389).

Moreover, suggested is a developing device which prevents retention of toner at a toner pressing face of a pressing member for regulating the thickness of toner by pressing the pressing member against the circumferential surface of the developing roller while development is not performed and, at the same time, moving the pressing member in the tangential direction thereof, so that the pressing face thereof can be always kept flat (see Japanese Patent Application Laid-Open No. 59-71069).

However, with the developing device in Japanese Patent Application Laid-Open No. 61-243474 which is constructed to rotate the developing roller backward by an angle between a doctor blade for thin film formation and a second doctor blade, the developing roller is rotated approximately half in the backward direction and toner adhered to the developing roller or to the photo conductor may splash to the outside. Moreover, toner which has entered the space between the surface of the developing roller and the doctor blade may not be removed sufficiently by backward rotation of the developing roller.

Moreover, with the developing device in Japanese Patent Application Laid-Open No. 4-281478 wherein the developing roller is rotated in the backward direction for approximately one minute, toner adhered to the developing roller or to the photo conductor may splash to the outside. Moreover, toner which has entered the space between the surface of the developing roller and the doctor blade may not be removed sufficiently by backward rotation of the developing roller.

Moreover, with the developing device in Japanese Patent Application Laid-Open No. 2003-280389 which is intended to charge toner, toner which has entered the space between the surface of the developing roller and the doctor blade may not be removed sufficiently. Furthermore, with the developing device in Japanese Patent Application Laid-Open No. 59-71069 which is constructed to press the pressing member against the circumferential surface of the developing roller while development is not performed and, at the same time, reciprocate the pressing member in the tangential direction thereof, toner adhered to the developing roller may splash to the outside. Moreover, frictional heat generated by reciprocation of the pressing member may melt adhered toner and cause further retention of toner.

BRIEF SUMMARY OF THE INVENTION

The present invention has been made in view of the above circumstances, and it is an object thereof to provide: a developing device which comprises a developing roller driving unit for rotating a developing roller backward and a suppression unit for suppressing a pressing force of a thickness regulating member when the developing roller is rotated backward, so as to remove toner which has entered the space between the surface of the developing roller and the thickness regulating member more easily than before and prevent fusion of toner; and an image forming apparatus comprising the developing device.

Another object of the present invention is to provide: a developing device wherein the suppression unit is constructed to separate the thickness regulating member from the surface of the developing roller so that toner stuck between the surface of the developing roller and the thickness regulating member can be removed reliably; and an image forming apparatus comprising the developing device.

Another object of the present invention is to provide: a developing device which comprises a cam-like rotor plate to be in contact with the thickness regulating member wherein the thickness regulating member is constructed to be driven by rotation of the cam-like rotor plate so that the pressing force of the thickness regulating member can be suppressed with a simple structure; and an image forming apparatus comprising the developing device.

Another object of the present invention is to provide: a developing device which comprises a first thickness regulating plate and a second thickness regulating plate separated from the first thickness regulating plate in said order upstream of a development position in a forward direction wherein a pressing force of the first thickness regulating plate is larger than a pressing force of the second thickness, regulating plate so that fusion of toner can be prevented and the thickness of toner can be equalized; and an image forming apparatus comprising the developing device.

Another object of the present invention is to provide: a developing device wherein a splash preventing plate for preventing splash of developer is provided in an upstream proximity of the development position in the forward direction to be in contact with a photo conductor and the developing roller is rotated backward within a range of a perimeter of the developing roller corresponding to a distance between the development position and a contact position of the splash preventing plate so that toner adhered to the developing roller or to the photo conductor can be prevented from splashing to the outside; and an image forming apparatus comprising the developing device.

Another object of the present invention is to provide: a developing device wherein the developing roller is rotated backward at a lowest speed of a plurality of different rotational speeds so that toner adhered to the developing roller or to the photo conductor can be prevented from splashing to the outside; and an image forming apparatus comprising the developing device.

Another object of the present invention is to provide an image forming apparatus which comprises a control unit for obtaining information relating to usage of the developing roller and controlling an amount of rotation in a case of backward rotation of the developing roller based on the obtained information so that fusion of toner can be suppressed regardless of the status of use.

Another object of the present invention is to provide an image forming apparatus which comprises a control unit for obtaining information relating to usage of the developing roller and controlling a frequency of backward rotation of the developing roller based on the obtained information so that fusion of toner can be suppressed regardless of the status of use.

Another object of the present invention is to provide an image forming apparatus which obtains information relating to an image formation density and controls an amount of backward rotation or a frequency of backward rotation of the developing roller based on the obtained information so that fusion of toner can be suppressed regardless of the density of an image to be formed.

A developing device according to the present invention is characterized by comprising: a developing roller for developing an electrostatic latent image on a photo conductor, a developing roller driving unit for rotating the developing roller in a forward direction and in a backward direction respectively while development is performed and not performed, a thickness regulating member, which is pressed against a surface of the developing roller, for regulating a thickness of developer adhered to the surface of the developing roller, and a suppression unit for suppressing a pressing force of the thickness regulating member when the developing roller is rotated in the backward direction.

A developing device according to the present invention is characterized in that the suppression unit separates the thickness regulating member from the surface of the developing roller.

A developing device according to the present invention is characterized in that the suppression unit comprises a cam-like rotor plate to be in contact with the thickness regulating member, and the thickness regulating member is constructed to be driven by rotation of the cam-like rotor plate.

A developing device according to the present invention is characterized in that the thickness regulating member comprises a first thickness regulating plate and a second thickness regulating plate separated from the first thickness regulating plate in said order upstream of a development position, where the electrostatic latent image is developed, in the forward direction, and a pressing force of the first thickness regulating plate is larger than a pressing force of the second thickness regulating plate.

A developing device according to the present invention is characterized by comprising a splash preventing plate, which is provided upstream of the development position in the forward direction to be in contact with the photo conductor, for preventing splash of developer, wherein the developing roller driving unit rotates the developing roller in the backward direction within a range of a perimeter of the developing roller corresponding to a distance between the development position and a contact position of the splash preventing plate.

A developing device according to the present invention is characterized in that the developing roller is rotatable at a plurality of different rotational speeds, and the developing roller driving unit rotates the developing roller in the backward direction at a lowest speed of the rotational speeds.

An image forming apparatus according to the present invention is characterized by comprising: a photo conductor for forming an electrostatic latent image, a developing device described in any one of claims 1 to 6 for developing the electrostatic latent image formed on the photo conductor and an image forming unit for transferring the electrostatic latent image developed by the developing device onto a sheet for completing an image formation.

An image forming apparatus according to the present invention is characterized by comprising an information obtaining unit for obtaining information relating to usage of the developing roller and a control unit for controlling an amount of rotation of the developing roller in the backward direction based on the information obtained by the information obtaining unit when the developing roller is rotated in the backward direction.

An image forming apparatus according to the present invention is characterized by comprising: an information obtaining unit for obtaining information relating to usage of the developing roller; and a control unit for controlling a frequency of rotation of the developing roller in the backward direction based on the information obtained by the information obtaining unit.

An image forming apparatus according to the present invention is characterized by comprising a density information obtaining unit for obtaining information relating to an image formation density, wherein the control unit controls a frequency of rotation of the developing roller in the backward direction based on the information obtained by the density information obtaining unit.

In the present invention, by rotating the developing roller backward while development is not performed and suppressing the pressing force of the thickness regulating member when the developing roller is rotated backward, developer (toner) which has entered the space between the surface of the developing roller and the thickness regulating member pressed against the surface of the developing roller is removed. That is, toner stuck between the surface of the developing roller and the thickness regulating member falls off the space between the developing roller and the thickness regulating member by rotating the developing roller backward, and developer is made more likely to fall down by suppressing the pressing force of the thickness regulating member (e.g., reducing the pressing force with the thickness regulating member being in contact with the surface of the developing roller or separating the thickness regulating member from the surface of the developing roller). This prevents particular toner from staying between the surface of the developing roller and the thickness regulating member for a long time and suppresses cohesion of toner.

In the present invention, the suppression unit separates the thickness regulating member from the surface of the developing roller. This makes a mass of toner more likely to fall down even when a relatively large mass of toner (developer) is stuck between the surface of the developing roller and the thickness regulating member.

In the present invention, by making a cam-like rotor plate in contact with the thickness regulating member, the thickness regulating member is driven by rotation of the cam-like rotor plate. For example, while development is performed, the thickness of developer is regulated by setting the cam-like rotor plate at a predetermined rotational position so as to make the thickness regulating member in contact with the surface of the developing roller with a required pressing force. While development is not performed, the pressing force is suppressed by rotating the cam-like rotor plate by a predetermined angle so as to drive the thickness regulating member in a direction opposite to the direction in which the pressing force of the thickness regulating member acts. The cam-like rotor plate can be driven to rotate by, for example, a stepping motor.

In the present invention, a first thickness regulating plate and a second thickness regulating plate are separately provided, in this order, upstream of a development position in a forward direction and the pressing force of the first thickness regulating plate is set larger than the pressing force of the second thickness regulating plate. The thickness of developer is regulated roughly by rotating the developing roller in a predetermined direction while development is formed so as to scrape off developer, which is adhered to the surface of the developing roller, by the first thickness regulating plate having a larger pressing force. The thickness of developer on the surface of the developing roller is then regulated with a high degree of accuracy by the second thickness regulating plate having a smaller pressing force and developer having a thickness regulated to a required amount is supplied to the development position where the photo conductor and the developing roller come close.

In the present invention, a splash preventing plate is provided in an upstream proximity of the development position in the forward direction to be in contact with the photo conductor. When rotating the developing roller backward while development is not performed, the developing roller is rotated backward within a range of a perimeter of the developing roller corresponding to a perimeter of the photo conductor between the development position and a contact position of the splash preventing plate. Developer adhered to the photo conductor is kept from splashing over the splash preventing plate to the outside as long as the amount of backward rotation of the developing roller is within a range of a perimeter of the developing roller corresponding to a perimeter of the photo conductor between the development position and the contact position of the splash preventing plate when the developing roller and the photo conductor are rotated backward in conjunction.

In the present invention, the developing roller is set to be rotatable at a plurality of different rotational speeds while development is performed. For example, three steps of rotational speeds of the developing roller and the photo conductor are set for a case where an image to be formed is a monochrome image, a case where an image to be formed is a color image and a case where chosen recording paper is cardboard. By rotating the developing roller backward not at a rotational speed different from preset rotational speeds in a predetermined direction but at the lowest rotational speed of the set rotational speeds, it becomes needless to provide a special drive mechanism for setting a rotational speed for backward rotation, and backward rotation at a low speed can prevent splash of developer.

In the present invention, information relating to the usage of the developing roller (e.g., the running distance of the developing roller, the cumulative number of revolutions of the developing roller or the like) is obtained and the amount of backward rotation in a case of backward rotation of the developing roller is controlled based on the obtained information. For example, the amount of backward rotation is increased according to an increase in the running distance or the cumulative number of revolutions of the developing roller. This makes it possible to remove toner before cohesion by increasing the amount of backward rotation even when the developing roller is used for a long time and a large quantity of toner stays between the surface of the developing roller and the thickness regulating member.

In the present invention, information relating to the usage of the developing roller (e.g., the running distance of the developing roller, the cumulative number of revolutions of the developing roller or the like) is obtained and the frequency of backward rotation in a case of backward rotation of the developing roller is controlled based on the obtained information. For example, the frequency of backward rotation is increased according to an increase in the running distance or the cumulative number of revolutions of the developing roller. This makes it possible to remove toner before cohesion by increasing the amount of backward rotation even when the developing roller is used for a long time and a large quantity of toner stays between the surface of the developing roller and the thickness regulating member.

In the present invention, information relating to an image formation density (e.g., the density of copy printing, the printing ratio of image formation or the like for each job of image formation) is obtained and the amount of backward rotation or the frequency of backward rotation in a case of backward rotation of the developing roller is controlled based on the obtained information. For example, the amount of backward rotation is set small or the frequency of backward rotation is set low when the density of copy printing is high, which means that the amount of development of developer (toner) at the development position is large, a small quantity of developer remains on the surface of the developing roller, the pressure of toner to the thickness regulating member is weak and toner fusion is less likely to take place. On the other hand, the amount of backward rotation is set large or the frequency of backward rotation is set high when the density of copy printing is low, which means that the amount of development of developer (toner) at the development position is small, a large quantity of developer remains on the surface of the developing roller, the pressure of toner to the thickness regulating member is strong and toner fusion is more likely to take place.

With the present invention which comprises a developing roller driving unit that can rotate a developing roller backward and a suppression unit for suppressing a pressing force of a thickness regulating member when the developing roller is rotated backward, it is possible remove toner which has entered the space between the surface of the developing roller and the thickness regulating member more easily than before and to prevent fusion of toner. It is also possible to prevent particular toner from staying between the surface of the developing roller and the thickness regulating member for a long time and to suppress cohesion of toner.

With the present invention wherein the suppression unit is constructed to separate the thickness regulating member from the surface of the developing roller, it is possible to make a mass of toner more likely to fall down even when a relatively large mass of toner (developer) is stuck between the surface of the developing roller and the thickness regulating member and to remove a mass of toner stuck between the surface of the developing roller and the thickness regulating member reliably.

With the present invention which comprises a cam-like rotor plate to be in contact with the thickness regulating member wherein the thickness regulating member is constructed to be driven by rotation of the cam-like rotor plate, it is possible to suppress the pressing force of the thickness regulating member with a simple structure.

With the present invention which comprises a first thickness regulating plate and a second thickness regulating plate separated from the first thickness regulating plate, in this order, upstream of a development position, where the photo conductor and the developing roller come close, in a forward direction wherein the pressing force of the first thickness regulating plate is larger than the pressing force of the second thickness regulating plate, it is possible to prevent fusion of toner while equalizing the thickness of toner.

With the present invention wherein a splash preventing plate for preventing splash of developer is provided in an upstream proximity of the development position in a predetermined direction to be in contact with the photo conductor and the developing roller is rotated backward within a range of a perimeter of the developing roller corresponding to a perimeter of the photo conductor between the development position and a contact position of the splash preventing plate, it is possible to prevent toner adhered to the developing roller or to the photo conductor from splashing to the outside.

With the present invention wherein the developing roller is rotated backward at a lowest speed of a plurality of different rotational speeds in a predetermined direction, it is needless to provide a special drive mechanism for setting the rotational speed for backward rotation and it is possible to prevent toner adhered to the developing roller or to the photo conductor from splashing to the outside.

With the present invention which comprises a control unit for obtaining information relating to the usage of the developing roller and controlling the amount of backward rotation in a case of backward rotation of the developing roller based on the obtained information, it is possible to suppress fusion of toner regardless of the status of use.

With the present invention which comprises a control unit for obtaining information relating to the usage of the developing roller and controlling the frequency of backward rotation of the developing roller based on the obtained information, it is possible to suppress fusion of toner regardless of the status of use.

With the present invention wherein information relating to an image formation density is obtained and the amount of backward rotation or the frequency of backward rotation of the developing roller is controlled based on the obtained information, it is possible to suppress fusion of toner regardless of the density of an image to be formed.

The above and further objects and features of the invention will more fully be apparent from the following detailed description with accompanying drawings.

BRIEF DESCRIPTION OF THE SEVERAL VIEWS OF THE DRAWINGS

FIG. 3 is an explanatory view showing an example of rotation control of a developing roller;

FIG. 4 is an explanatory view showing an example of the amount of backward rotation in a case where the developing roller is rotated backward;

FIG. 5 is an explanatory view showing an example of the frequency of backward rotation in a case where the developing roller is rotated backward;

FIG. 6 is an explanatory view showing another example of the frequency of backward rotation in a case where the developing roller is rotated backward;

DETAILED DESCRIPTION OF THE INVENTION

Figure 1:
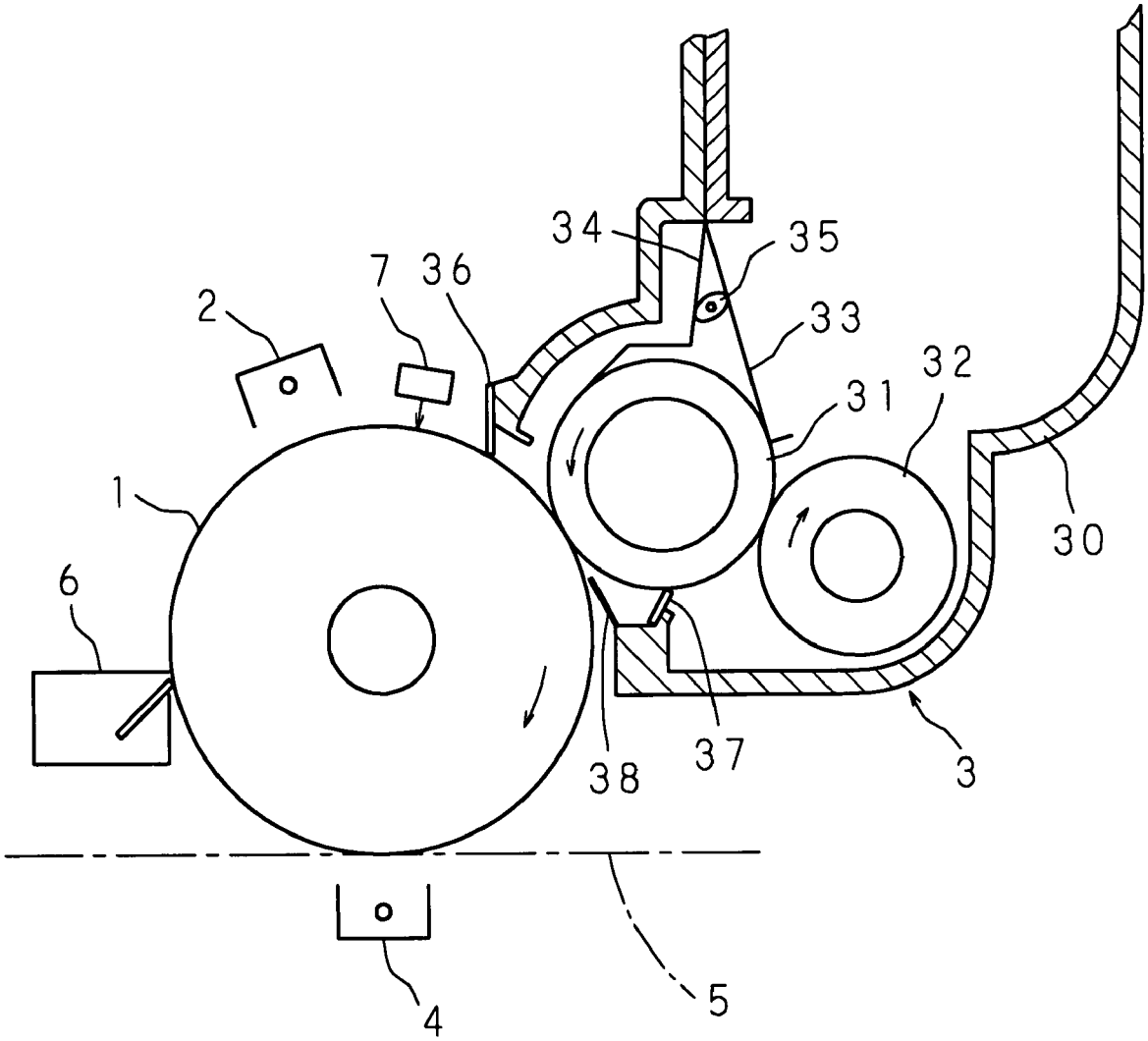
FIG. 1 is a schematic view showing the essential structure of an image forming apparatus comprising a developing device according to the present invention.

The following description will explain the present invention with reference to the drawings illustrating an embodiment thereof. FIG. 1 is a schematic view showing the essential structure of an image forming apparatus comprising a developing device according to the present invention. Denoted at 1 in the figure is a drum-like photo conductor (image holder). The photo conductor 1 is rotated in the direction indicated by an arrow in the figure by a brushless motor which will be explained later. Provided around the photo conductor 1 along the rotational direction are: a charging element 2 for charging the surface of the photo conductor 1 to a predetermined and uniform potential; a developing device 3 for supplying toner to the surface of the photo conductor 1, on which an electrostatic latent image is formed, so as to make the electrostatic latent image visible as a toner image; a transfer element 4 for transferring the developed electrostatic latent image to recording paper 5; a cleaning device 6 for recovering toner remaining on the photo conductor 1; and the like.

The surface of the photo conductor 1 between the charging element 2 and the developing device 3 is irradiated with a laser beam or an LED beam from an optical writing unit 7 (reflected light from the original) and an electrostatic latent image is formed there by means of photoconductive action caused by the irradiation.

The developing device 3 comprises a case 30 having a required shape, which holds single-component developer (toner having a particle diameter of, for example, approximately 7~8 μm) prepared by mixing colorant and magnetic powder into synthetic resin. Provided in the case 30 are: a developing roller 31 which is placed opposite to the surface of the photo conductor 1 to have a predetermined interval; and a toner supplying roller 32 placed parallel to the developing roller 31. The developing roller 31 and the toner supplying roller 32 are joined with the photo conductor 1 by a driving gear, which will be explained later, so as to be driven by the brushless motor to rotate in the direction indicated by arrows in the figure (forward rotation). It should be noted that the developing roller 31, the photo conductor 1 and the like can be rotated in conjunction in a direction opposite to the direction indicated by the arrows in the figure (backward rotation) by reversing rotation of the brushless motor.

Provided on the surface of the developing roller 31 are a first doctor blade 33 and a second doctor blade 34 which are lamellar blades (made of stainless material and having a thickness of approximately 0.1 mm, for example) provided separately and pressed by predetermined pressure.

The pressing force of the first doctor blade 33 is set larger than the pressing force of the second doctor blade 34. The first doctor blade 33 regulates the thickness of toner roughly by scraping off toner which has been supplied to the surface of the developing roller 31 by the toner supplying roller 32. The second doctor blade 34 having a smaller pressing force then regulates the thickness of toner on the surface of the developing roller 31 with a high degree of accuracy to a required thickness (e.g., approximately 10~30 μm) so that toner having a thickness regulated to a required amount is supplied to a development position where the photo conductor 1 and the developing roller 31 come close. In this manner, a certain amount of toner is always supplied to the development position of the photo conductor 1.

A cam plate 35 placed to be rotatable is provided between the first doctor blade 33 and the second doctor blade 34. The cam plate 35 is driven by a stepping motor which will be explained later and the first doctor blade 33 and the second doctor blade 34 are driven by the rotation of the cam plate 35. That is, the cam plate 35 is constructed to turn between a first rotational position where the first doctor blade 33 and the second doctor blade 34 are pressed against the surface of the developing roller 31 by predetermined pressure and a second rotational position where the pressing force of the first doctor blade 33 and the second doctor blade 34 is suppressed.

In the second rotational position, the pressing force may be suppressed with the first doctor blade 33 and the second doctor blade 34 being in contact with the surface of the developing roller 31, or the first doctor blade 33 and the second doctor blade 34 may be separated from the surface of the developing roller 31 by a required distance (e.g., approximately 0.1 mm~0.5 mm).

A splash preventing plate 36 made of synthetic resin is provided at an end portion of the case 30 on the optical writing unit 7 side to be in contact with the surface of the photo conductor 1 in order to prevent toner remaining on the surface of the photo conductor 1 or toner adhered to the surface of the developing roller 31 from splashing to the outside. Another splash preventing plate 37 made of synthetic resin is provided at the opposite end portion of the case 30 across the developing roller 31 to be in contact with the surface of the developing roller 31 in order to prevent held toner from splashing to the outside, and a toner receiver 38 for receiving splashing toner when toner adhered to the developing roller 31 splashes is provided around the splash preventing plate 37.

Figure 2:
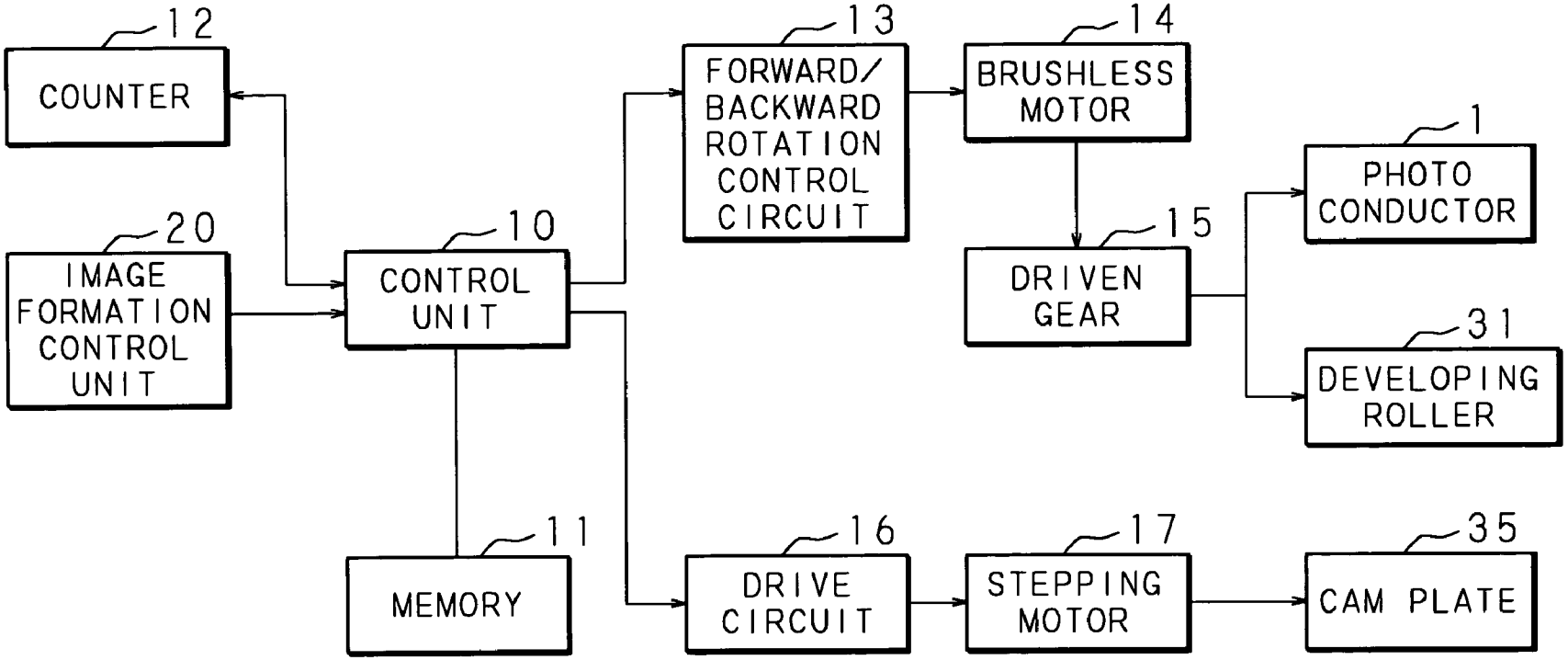
FIG. 2 is a block diagram showing the structure of an image forming apparatus according to the present invention.

FIG. 2 is a block diagram showing the structure of an image forming apparatus according to the present invention. Denoted at 10 in the figure is a control unit. The control unit 10 is constituted of, for example, a microcomputer. The control unit 10 is connected with a memory 11. The memory 11 is constituted of a nonvolatile memory or an HDD and stores data and a program for controlling the operation of the control unit 10.

An image formation control unit 20 is constituted of a CPU and is intended to control the entire image forming process. The image formation control unit 20 outputs a power on signal or a power off signal to the control unit 10 according to power on or off of the image forming apparatus. The image formation control unit 20 also outputs a job start signal and a job end signal to the control unit 10, which are indicative of start of image formation (i.e., start of a job) and end of image formation (i.e., end of a job). For example, the image formation control unit 20 outputs a job start signal to the control unit 10 when a job of image formation (printing) is made. It should be noted that the job in this case means a series of process to be performed in succession by a single operation of the user.

The image formation control unit 20 outputs, to the control unit 10, cumulative print number information indicative of the cumulative number of prints (e.g., the number of prints corresponding to one-side printing on A4 paper or the like) of recording paper on which an image has been formed. The image formation control unit 20 also outputs, to the control unit 10, printing mode information indicative of the printing mode (e.g., cardboard, color, monochrome or the like) for image formation. The control unit 10 stores the inputted cumulative print number information and printing mode information in the memory 11.

The image formation control unit 20 outputs, to the control unit 10, a printing density signal indicative of the printing density of image formation for each job. The printing density can be calculated based on, for example, the luminance value, the luminance distribution, the printing ratio or the like included in image data read from the original by a scanner unit (not illustrated). When printing is performed for a plurality of sheets of recording paper in one job, the mean value, the intermediate value, the maximum value, the minimum value or the like of the printing density can be used as the printing density of the job.

When the printing density is relatively high, which means that the amount of toner to be developed at the development position on the photo conductor 1 is large, a small quantity of toner remains on the surface of the developing roller 31, the pressure of toner to the doctor blades 33 and 34 (force of toner opposing the pressing force of the doctor blades 33 and 34) is weak and toner fusion or toner cohesion, which may be caused when toner that has entered the space between the doctor blades 33 and 34 and the surface of the developing roller 31 stays for a long time, is less likely to take place.

On the other hand, when the printing density is low, which means that the amount of toner to be developed at the development position on the photo conductor 1 is small, a large quantity of toner remains on the surface of the developing roller 31, the pressure of toner to the doctor blades 33 and 34 (force of toner opposing the pressing force of the doctor blades 33 and 34) is strong and toner fusion or toner cohesion, which may be caused when toner that has entered the space between the doctor blades 33 and 34 and the surface of the developing roller 31 stays for a long time, is more likely to take place.

The control unit 10 outputs a forward rotation signal to a forward/backward rotation control circuit 13 according to the printing mode information obtained from the image formation control unit 20. The forward/backward rotation control circuit 13 outputs a driving signal to a brushless motor 14 based on the inputted forward rotation signal. The rotating shaft of the brushless motor 14 is joined with a driving gear 15, so that the photo conductor 1 and the developing roller 31 are rotated in a predetermined direction (forward rotational direction) when the brushless motor 14 is driven to rotate.

The control unit 10 is connected with a counter 12, which counts the driving speed (rotational speed) and the time of rotation of the developing roller 31 based on the forward rotation signal outputted from the control unit 10 to the forward/backward rotation control circuit 13 and outputs the counting result to the control unit 10. The control unit 10 calculates the running distance of the developing roller 31 based on the counting result and the diameter of the developing roller 31 (e.g., 16 mm or the like) and stores the calculation result in the memory 11.

The control unit 10 counts the cumulative number of jobs based on a job start signal or a job end signal inputted from the image formation control unit 20 and stores the counting result in the memory 11. The control unit 10 also determines whether the counted cumulative number of jobs is equal to a preset cumulative number of jobs (predetermined cumulative number of jobs) or not, and outputs, to the forward/backward rotation control circuit 13, a backward rotation signal for rotating the developing roller 31 in a direction opposite to a predetermined direction (backward rotational direction) while development is not performed when the counted cumulative number of jobs is equal to the preset cumulative number of jobs. The forward/backward rotation control circuit 13 outputs a driving signal to the brushless motor 14 based on the inputted backward rotation signal. When the brushless motor 14 is driven to rotate, the photo conductor 1 and the developing roller 31 are rotated in a direction opposite to a predetermined direction (backward rotational direction).

For rotating the developing roller 31 in the backward direction, the control unit 10 sets the amount of backward rotation (distance along the periphery of the developing roller 31 or the rotational angle) according to the running distance of the developing roller 31 stored in the memory 11.

For outputting a backward rotation signal to rotate the developing roller 31 in the backward direction, the control unit 10 outputs a suppression driving signal to a drive circuit 16 in order to rotate the cam plate 35 from the first rotational position to the second rotational position. For stopping the output of a backward rotation signal in order to stop the rotation of the developing roller 31 in the backward direction, the control unit 10 outputs a suppression release driving signal to the drive circuit 16 so as to rotate the cam plate 35 from the second rotational position to the first rotational position.

The drive circuit 16 drives a stepping motor 17 to rotate the cam plate 35 from the first rotational position to the second rotational position based on the inputted suppression driving signal, or drives the stepping motor 17 to rotate the cam plate 35 from the second rotational position to the first rotational position based on the inputted suppression release driving signal.

The output timing of the backward rotation signal and the suppression driving signal is set so that the pressing force of the first doctor blade 33 and the second doctor blade 34 is suppressed after the developing roller 31 is rotated in the backward direction and suppression of the pressing force of the first doctor blade 33 and the second doctor blade 34 is released after the rotation of the developing roller 31 in the backward direction is stopped. In particular, for example, the pressing force of the first doctor blade 33 and the second doctor blade 34 is suppressed and the blades are separated from the surface of the developing roller 31 in the last half of time required for rotating the developing roller 31 backward by a required amount of backward rotation.

The control unit 10 compares the printing density signal inputted from the image formation control unit 20 with a density threshold stored in the memory 11. When the printing density is lower than the density threshold, the control unit 10 determines that a large quantity of toner remains on the surface of the developing roller 31 and outputs a backward rotation signal and a suppression driving signal respectively to the forward/backward rotation control circuit 13 and the drive circuit 16 after jobs of image formation end.

FIG. 3 is an explanatory view showing an example of rotation control of the developing roller 31. For performing development, as shown in the figure, the developing roller 31 is to be rotated forward at a low speed, a medium speed or a high speed according to a printing mode of "cardboard", "color" or "monochrome". While development is not performed, the developing roller 31 is to be rotated backward at a low speed (the same rotational speed as the low speed for forward rotation). In this manner, by rotating the developing roller 31 not at a rotational speed different from preset rotational speeds in the forward rotational direction but at the lowest rotational speed of the set rotational speeds, it becomes needless to provide a special driving gear for setting a rotational speed for backward rotation, and toner remaining on the surface of the photo conductor 1 or on the surface of the developing roller 31 can be prevented from splashing since the developing roller 31 is rotated backward at a low speed.

FIG. 4 is an explanatory view showing an example of the amount of backward rotation in a case where the developing roller 31 is rotated backward. The running distance of the developing roller in the figure is calculated based on the rotational speed, the time of rotation and the diameter (e.g., 16 mm) of the developing roller 31. The cumulative number of revolutions of the developing roller is calculated based on the rotational speed and the time of rotation of the developing roller 31. The number of A4 single prints is the equivalent of the number of prints assuming that A4 one-side printing is performed in succession for the running distance of the developing roller 31. The amount of backward rotation of the developing roller is the travel distance on the periphery of the developing roller 31 having a diameter of 16 mm or the rotational angle of the developing roller 31.

For setting the amount of backward rotation of the developing roller 31, it is possible to use any one of the running distance of the developing roller, the cumulative number of revolutions of the developing roller and the number of A4 single prints. For example, in a case where the running distance of the developing roller is used, the amount of backward rotation of the developing roller 31 is 0.5 mm (3.58°) when the running distance of the developing roller is within a range of 0~1,500,000 mm. As shown in the figure, the amount of backward rotation of the developing roller 31 is increased as the running distance of the developing roller is increased. In this manner, even when the developing roller 31 is used for a long time and a large quantity of toner stays between the surface of the developing roller 31 and the doctor blades 33 and 34, toner can be removed before cohesion by increasing the amount of backward rotation.

FIG. 5 is an explanatory view showing an example of the frequency of backward rotation in a case where the developing roller 31 is rotated backward. Since the running distance of the developing roller, the cumulative number of revolutions of the developing roller and the number of A4 single prints in the figure are the same as those in FIG. 4, explanation thereof will be omitted. For setting the frequency of backward rotation of the developing roller 31, it is possible to use any one of the running distance of the developing roller, the cumulative number of revolutions of the developing roller and the number of A4 single prints. For example, in a case where the running distance of the developing roller is used, backward rotation of the developing roller 31 is performed only after warming up (e.g., at the time of power activation) when the running distance of the developing roller is within a range of 0~1,500,000 mm. When the running distance of the developing roller is within a range of 1,500,000~3,000,000 mm, backward rotation of the developing roller 31 is performed after warming up (e.g., at the time of power activation) and every time ten jobs are made.

As shown in the figure, the frequency of backward rotation of the developing roller 31 is increased as the running distance of the developing roller is increased. In this manner, even when the developing roller 31 is used for a long time and a large quantity of toner stays between the surface of the developing roller 31 and the doctor blades 33 and 34, toner can be removed before cohesion by increasing the frequency of backward rotation.

FIG. 6 is an explanatory view showing another example of the frequency of backward rotation in a case where the developing roller 31 is rotated backward. Since the running distance of the developing roller in the figure is the same as that in FIG. 4, explanation thereof will be omitted. The cumulative number of A4 prints is the actual number of prints when converted to its equivalent in A4 size. The ratio of the running distance of the developing roller to the number of A4 prints (running distance of the developing roller/number of A4 prints) means the running distance of the developing roller per the number of A4 prints. The equivalent of the number of A4 intermission sheets used corresponds to the ratio of a non-printing operation to a printing operation when the developing roller 31 is rotated. For setting the frequency of backward rotation of the developing roller 31, it is possible to use any one of the (running distance of the developing roller/number of A4 prints) and the equivalent of the number of A4 intermission sheets used.

For example, in a case where the (running distance of the developing roller/number of A4 prints) is used, backward rotation of the developing roller 31 is not performed when the (running distance of the developing roller/number of A4 prints) is smaller than 428. When the (running distance of the developing roller/number of A4 prints) is equal to or larger than 428 and smaller than 856, backward rotation of the developing roller 31 is performed after warming up (e.g., at the time of power activation) and every time ten jobs are made. As shown in the figure, the frequency of backward rotation of the developing roller 31 is increased as the (running distance of the developing roller/number of A4 prints) is increased. In this manner, even when the developing roller 31 is used for a long time and a large quantity of toner stays between the surface of the developing roller 31 and the doctor blades 33 and 34, toner can be removed before cohesion by increasing the frequency of backward rotation.

Figure 7:
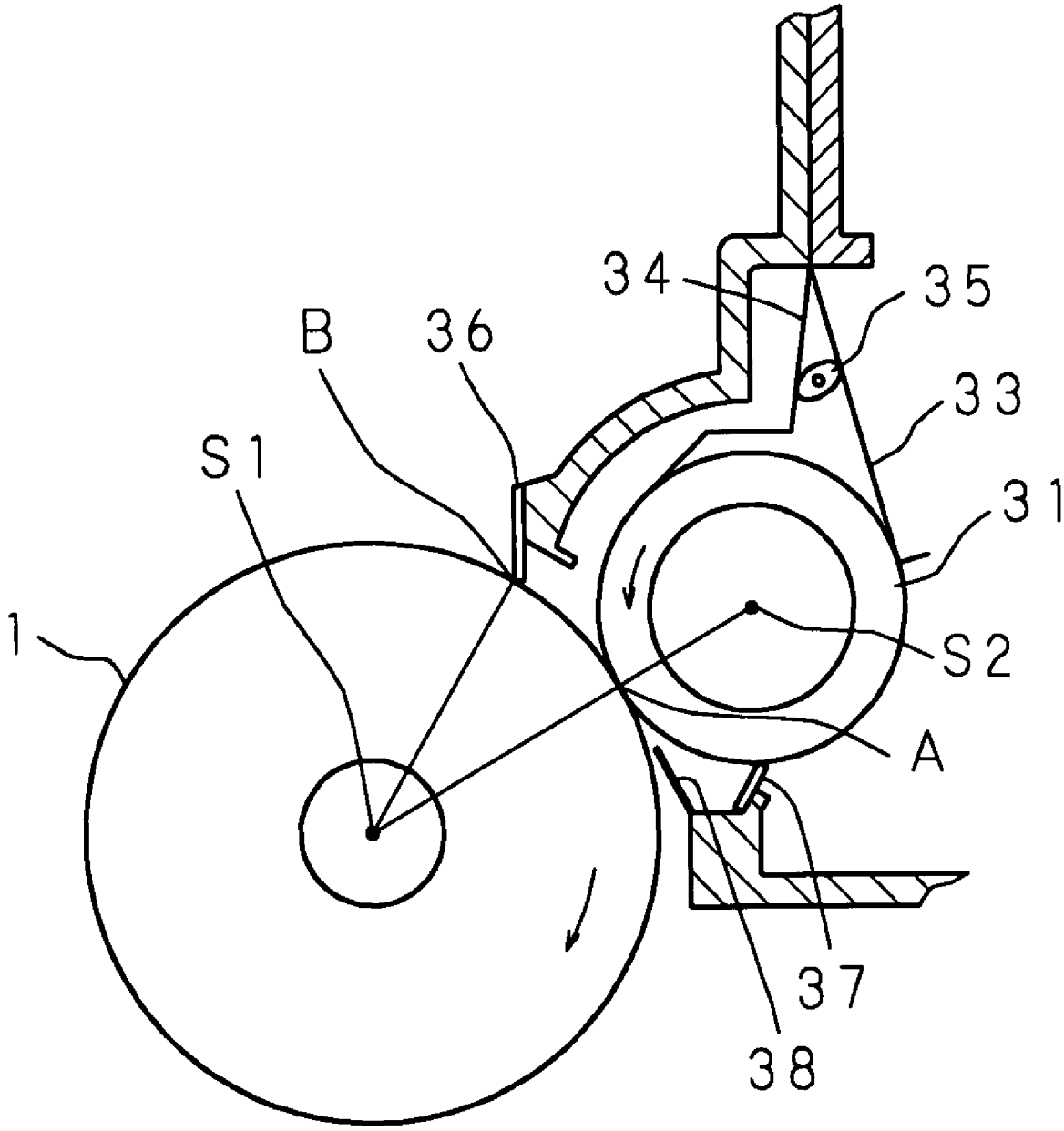
FIG. 7 is a schematic view of a case where the developing roller is rotated forward.

The following description will explain the operation of an image forming apparatus according to the present invention. FIG. 7 is a schematic view of a case where the developing roller 31 is rotated forward. The cam plate 35 is in the first rotational position where the first doctor blade 33 and the second doctor blade 34 are pressed against the surface of the developing roller 31 by predetermined pressure. In this manner, when the developing roller 31 is rotated forward (in the direction indicated by an arrow in FIG. 7), the first doctor blade 33 regulates the thickness of toner roughly by scraping off toner supplied to the surface of the developing roller 31. The second doctor blade 34 having a pressing force smaller than the first doctor blade 33 then regulates the thickness of toner on the developing roller 31 into a required thickness with a high degree of accuracy, so that toner having a thickness regulated to a required amount is supplied to a development position (adjacent to the point A where a line connecting the center S1 of the photo conductor 1 and the center S2 of the developing roller 31 crosses the photo conductor 1 in the figure) where the photo conductor 1 and the developing roller 31 come close.

The developing roller 31 is rotated backward so that the amount of backward rotation of the developing roller 31 is within a range (maximum amount of backward rotation) of a perimeter of the developing roller 31 corresponding to a perimeter of the photo conductor 1 between the point A on the photo conductor 1 and a contact position (point B in the figure) where the splash preventing plate 36 is in contact with the photo conductor 1.

Figure 8:
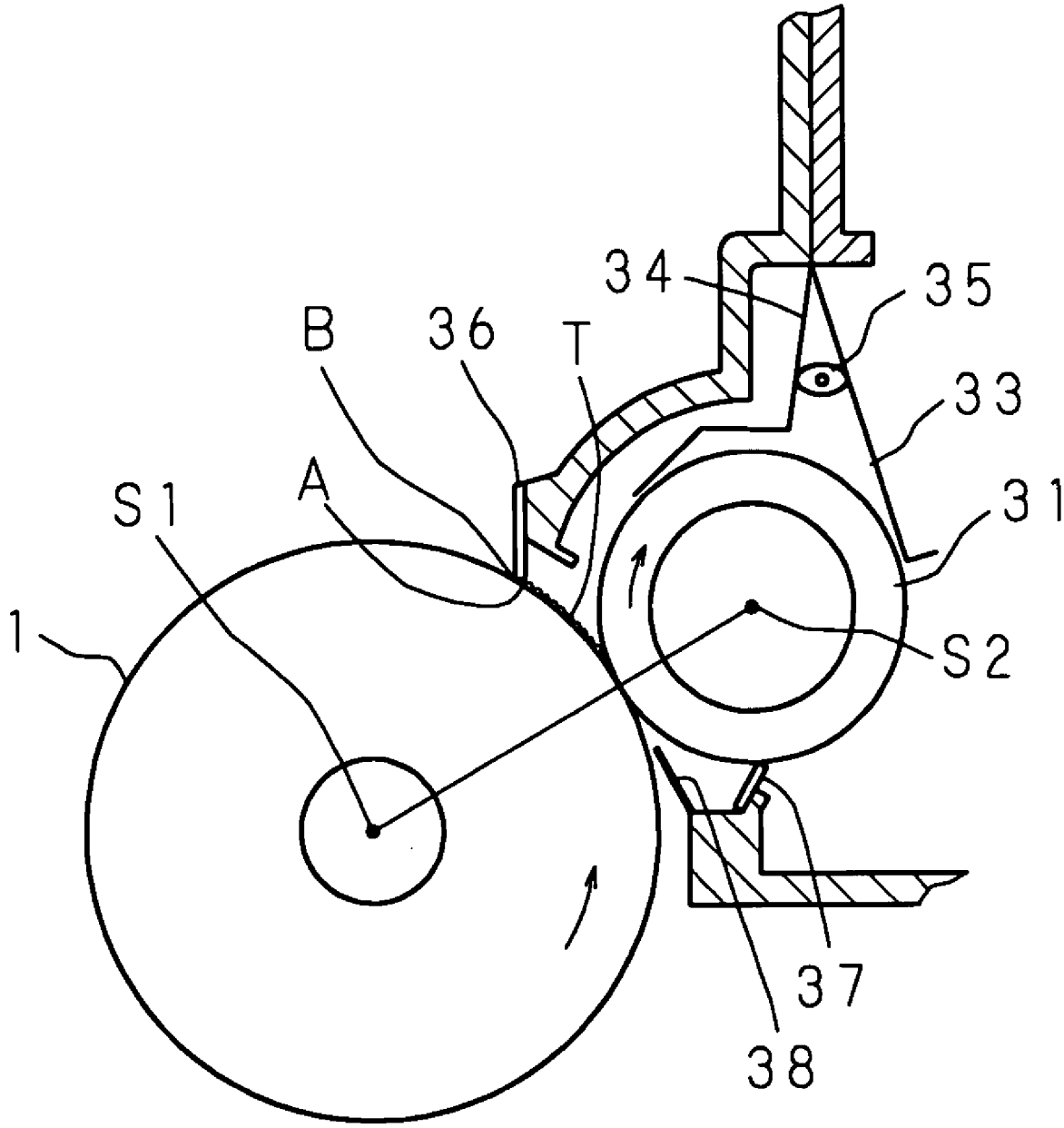
FIG. 8 is a schematic view of a case where the developing roller is rotated backward.

FIG. 8 is a schematic view of a case where the developing roller 31 is rotated backward. After backward rotation (in the direction indicated by an arrow in FIG. 8) of the developing roller 31 starts, the cam plate 35 is rotated to the second rotational position in order to suppress the pressing force of the first doctor blade 33 and the second doctor blade 34. In the figure, the first doctor blade 33 and the second doctor blade 34 are separated from the surface of the developing roller 31 by a required distance. In this manner, after backward rotation of the developing roller 31 starts, the first doctor blade 33 and the second doctor blade 34 are separated from the surface of the developing roller 31 while the developing roller 31 is rotated backward.

When the developing roller 31 is rotated backward so that the amount of backward rotation of the developing roller 31 does not exceed the perimeter of the developing roller 31 corresponding to the perimeter of the photo conductor 1 between the point A on the photo conductor 1 and the contact position (point B in the figure) where the splash preventing plate 36 is in contact with the photo conductor 1, toner T remaining adjacent to the point A does not splash over the contact position (point B), where the splash preventing plate 36 is in contact with the photo conductor 1, to the outside. In this manner, it is possible, for example, to prevent a light emitting face of the optical writing unit 7 or the like provided adjacent to the photo conductor 1 from being contaminated by splashing toner.

Figure 9A:
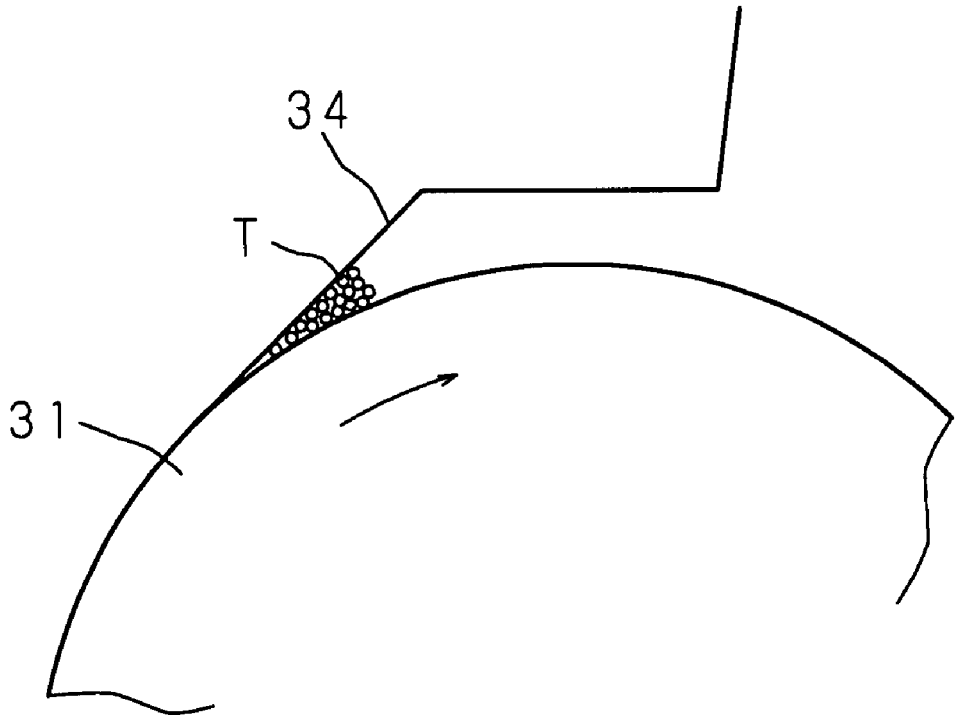
FIGS. 9A and 9B are explanatory views showing the state of toner which piles up between a second doctor blade and the surface of the developing roller.
Figure 9B:
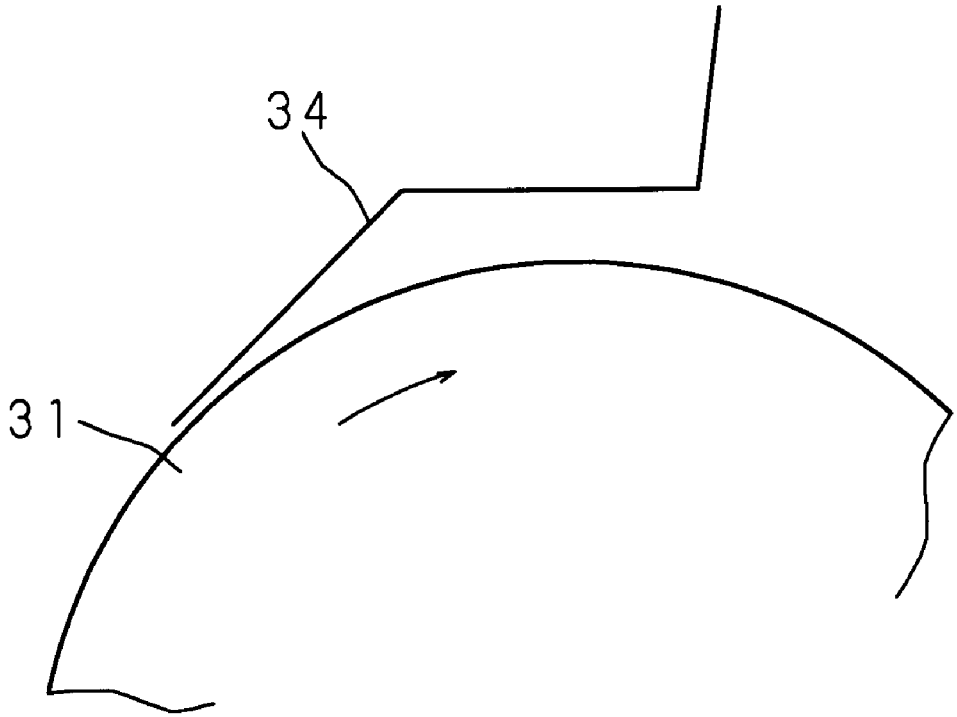

FIGS. 9A and 9B, are explanatory views showing the state of toner which piles up between the second doctor blade 34 and the surface of the developing roller 31. FIG. 9A shows a state where the developing roller 31 is rotated backward with the pressing force of the second doctor blade 34 for forward rotation of the developing roller 31 being maintained. As shown in FIG. 9A, since the pressing force of the second doctor blade 34 is maintained, toner T pressed by the pressing force of the second doctor blade 34 remains between the second doctor blade 34 and the surface of the developing roller 31 even when the developing roller 31 is rotated backward.

FIG. 9B shows a state where the developing roller 31 is rotated backward with the pressing force of the second doctor blade 34 toward the surface of the developing roller 31 being suppressed (in particular, with the second doctor blade 34 being separated from the surface of the developing roller 31 by a required distance). As shown in FIG. 9B, since the pressing force of the second doctor blade 34 is suppressed, toner which has remained between the second doctor blade 34 and the surface of the developing roller 31 falls off the space between the developing roller 31 and the second doctor blade 34 and is removed by backward rotation of the developing roller 31. A relatively large mass of toner can also be removed easily since the second doctor blade 34 is separated from the surface of the developing roller 31 by a required distance. It should be noted that the same goes for the first doctor blade 33 and explanation thereof will be omitted.

Figure 10:
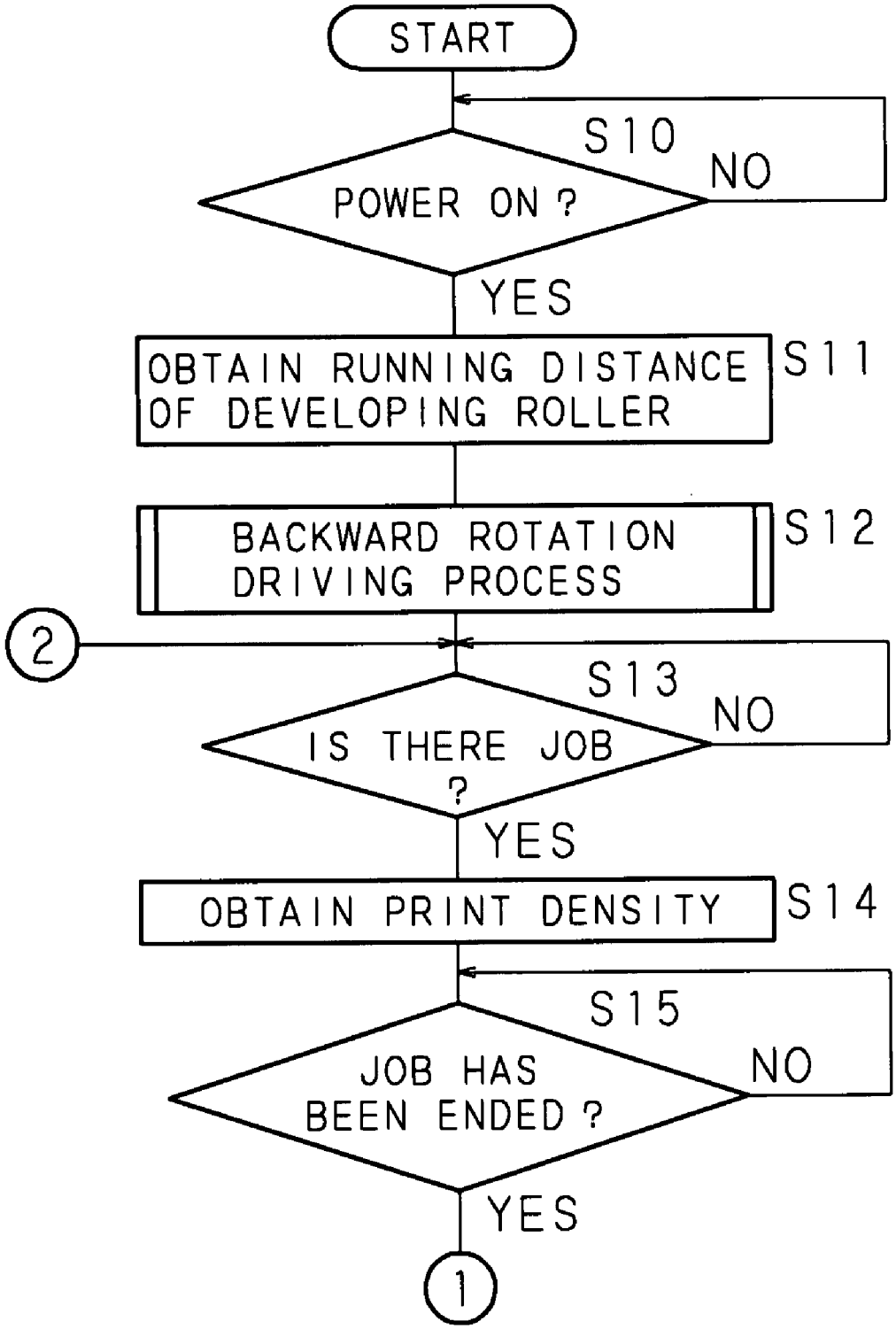
FIG. 10 is a flow chart showing the process procedure of a control unit.
Figure 11:
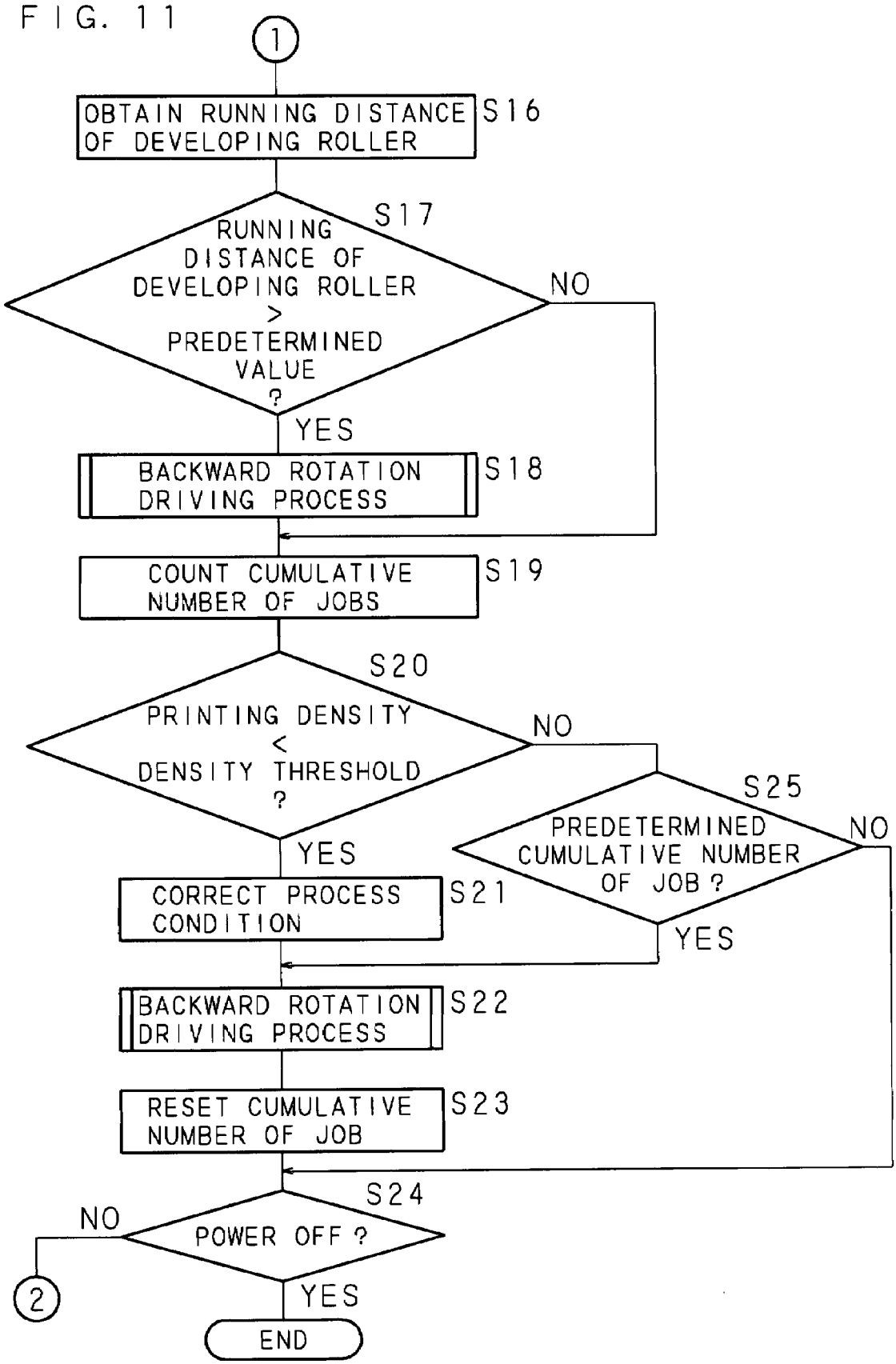
FIG. 11 is a flow chart showing the process procedure of a control unit.

FIGS. 10 and 11 are a flow chart showing the process procedure of the control unit 10. The control unit 10 determines whether an operation for power on has been made or not (S10), and continues the process in the step S10 waiting for an operation for power on when an operation for power on has not been made (NO in S10).

When an operation for power on has been made (YES in S10), the control unit 10 obtains the running distance of the developing roller stored in the memory 11 (S11) and performs a backward rotation driving process for rotating the developing roller 31 backward after warming up and suppressing the pressing force of the first and second doctor blades 33 and 34 (S12). It should be noted that the backward rotation driving process will be explained later. The control unit 10 determines whether there is a job for image formation or not (S13), and continues the process in the step S13 waiting for a job when there is no job (NO in S13).

When there is a job (YES in S13), the control unit 10 obtains the printing density relating to the job (S14) and determines whether the job has been ended or not (S15). When the job has not been ended (NO in S15), the control unit 10 continues the process in the step S15 waiting for end of the job.

When the job has been ended (YES in S15), the control unit 10 obtains the running distance of the developing roller stored in the memory 11 (S16) and determines whether the running distance of the developing roller is larger than a predetermined value or not (S17). When the running distance of the developing roller is larger than the predetermined value (YES in S17), the control unit 10 performs the backward rotation driving process (S18) and counts the cumulative number of jobs (S19). When the running distance of the developing roller is not larger than the predetermined value (NO in S17), the control unit 10 performs the process in the step S19.

The control unit 10 determines whether the obtained printing density is lower than a preset density threshold or not (S20). When the printing density is lower than the density threshold (YES in S20), the control unit 10 determines that the amount of toner to be developed at the photo conductor 1 is small, and corrects the process conditions such as charging or development conditions (S21) and performs the backward rotation driving process (S22). It should be noted that the process to be performed in the steps S18 and S22 is the same as the process to be performed in the step S12. The control unit 10 resets (sets to "0") the counted cumulative number of jobs (S23) and determines whether an operation for power off has been made or not (S24).

When the printing density is not lower than the density threshold in the step S20 (NO in S20), the control unit 10 determines whether the counted cumulative number of jobs is a predetermined cumulative number of jobs or not (S25). When the counted cumulative number of jobs is the predetermined cumulative number of jobs (YES in S25), the control unit 10 continues the processes after the step S22.

When the counted cumulative number of jobs is not the predetermined cumulative number of jobs (NO in S25), the control unit 10 continues the processes after the step S24. When an operation for power off has not been made (NO in S24), the control unit 10 performs the processes after the step S13. When an operation for power off has been made (YES in S24), the control unit 10 terminates the process.

Figure 12:
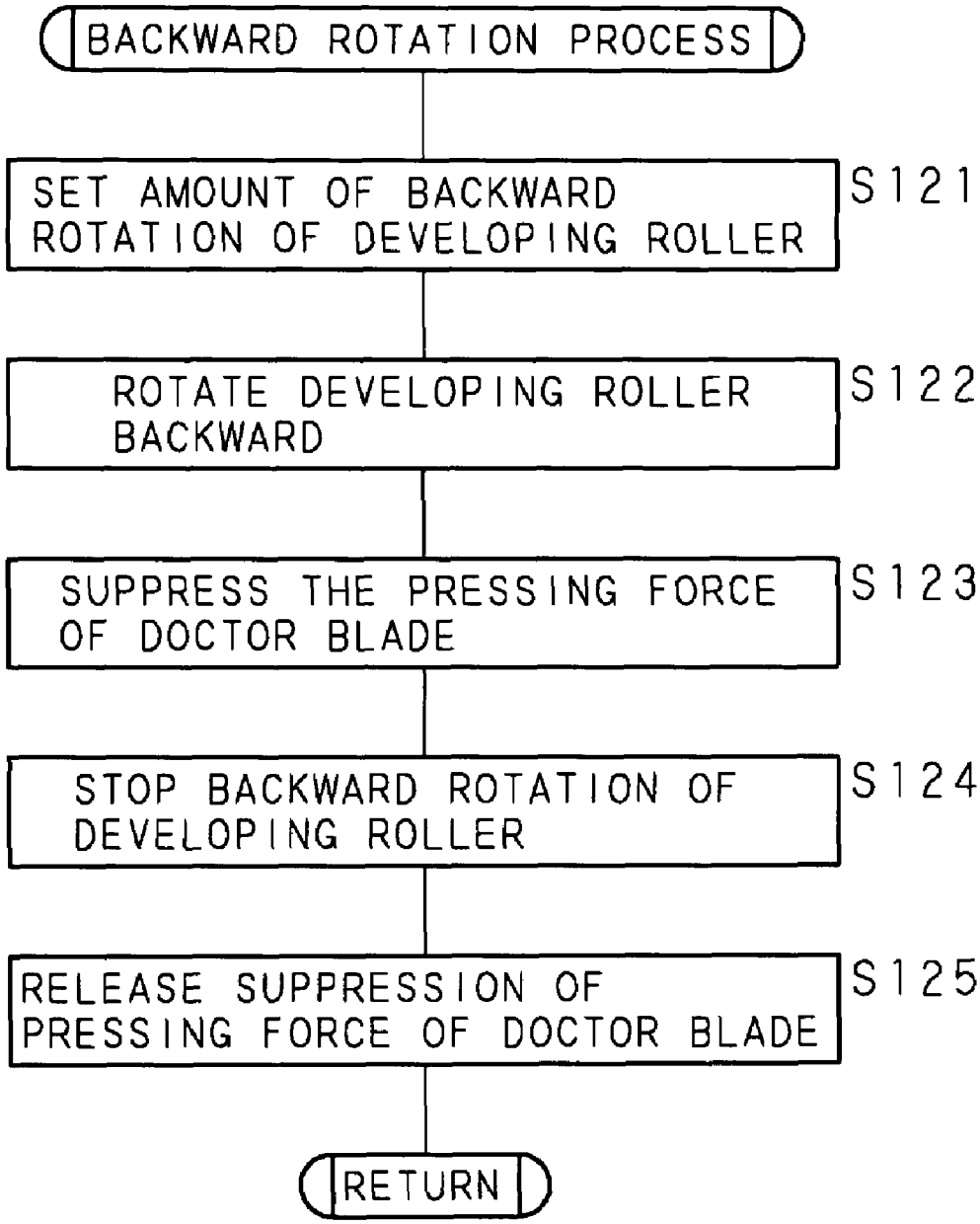
FIG. 12 is a flow chart showing the procedure of a backward rotation driving process.

FIG. 12 is a flow chart showing the procedure of the backward rotation driving process. The control unit 10 sets the amount of backward rotation of the developing roller 31 based on the obtained running distance of the developing roller (S121) and rotates the developing roller 31 backward (S122). After backward rotation of the developing roller 31 starts, the control unit 10 suppresses the pressing force of the doctor blades 33 and 34 (S123).

After the developing roller 31 is rotated backward by the set amount of backward rotation within a range which does not exceed the maximum amount of backward rotation, the control unit 10 stops backward rotation (S124), releases the suppression of the pressing force of the doctor blades 33 and 34 (S125) and terminates the backward rotation driving process.

It should be noted that, though the process explained above is a case of obtaining the running distance of the developing roller as information relating to image information, it is also possible to use information, instead of the running distance of the developing roller, such as the cumulative number of revolutions of the developing roller, the number of A4 single prints, the ratio of the running distance of the developing roller to the number of A4 prints or the equivalent of the number of A4 intermission sheets used.

With the present invention, as explained above, by suppressing the pressing force of the doctor blades 33 and 34 when the developing roller 31 is rotated backward, it is possible to remove toner which has entered the space between the surface of the developing roller 31 and the doctor blades 33 and 34 more easily than before and to prevent fusion of toner. It is also possible to prevent particular toner from staying between the surface of the developing roller 31 and the doctor blades 33 and 34 for a long time and to suppress cohesion of toner.

Moreover, by separating the doctor blades 33 and 34 from the surface of the developing roller 31 when the developing roller 31 is rotated backward, it is possible to make a mass of toner more likely to fall down even when a relatively large mass of toner is stuck between the surface of the developing roller 31 and the doctor blades 33 and 34 and to remove a mass of toner reliably.

Moreover, by providing the cam plate 35, which is driven by the stepping motor 17, as means for suppressing the pressing force of the doctor blades 33 and 34 so that the doctor blades 33 and 34 are driven when the cam plate 35 is rotated, it is possible to suppress the pressing force of the doctor blades 33 and 34 with a simple structure. Moreover, since the pressing force of the first doctor blade 33 is set larger than the pressing force of the second doctor blade 34, it is possible to prevent fusion of toner while equalizing the thickness of toner.

Moreover, since the developing roller 31 is rotated backward so that the amount of backward rotation of the developing roller 31 (distance on the circumferential surface of the developing roller 31) does not exceed the perimeter of the developing roller 31 corresponding to the perimeter of the photo conductor 1 between the point A on the photo conductor 1 and the contact position (point B in the figure) where the splash preventing plate 36 is in contact with the photo conductor 1, it is possible to prevent toner adhered to the surface of the photo conductor 1 or to the surface of the developing roller 31 from splashing to the outside. Moreover, since the developing roller 31 is rotated backward at the lowest speed of rotational speeds set for forward rotation, it is needless to provide a special drive mechanism for setting the rotational speed for backward rotation and it is possible to prevent toner adhered to the developing roller 31 or to the photo conductor 1 from splashing.

Moreover, by determining whether the developing roller 31 is to be rotated backward or not based on information such as the running distance of the developing roller or the printing density and controlling the amount of backward rotation or the frequency of backward rotation of the developing roller 31, it is possible to suppress fusion of toner regardless of the status of use.

In the above embodiment, the numerical value such as the running distance of the developing roller, the cumulative number of revolutions of the developing roller, the number of A4 single prints, the ratio of the running distance of the developing roller to the number of A4 prints or the equivalent of the number of A4 intermission sheets used is an example and the present invention is not limited to this. Moreover, since the amount of backward rotation of the developing roller 31 is also an example and the present invention is not limited to this, the amount of backward rotation of the developing roller 31 can be changed suitably according to the diameter of the developing roller 31.

Though the above embodiment is constructed using the stepping motor 17, the cam plate 35 and the like as means for suppressing the pressing force of the doctor blades 33 and 34, the present invention is not limited to this, and structure for driving the doctor blades 33 and 34 with a member which can move linearly or swing or structure for pressing the doctor blades 33 and 34 with an elastic member can be used as long as the pressing force can be suppressed.

Though the above embodiment is constructed to separate both of the doctor blades 33 and 34 from the surface of the developing roller 31, the present invention may be constructed not to separate the blades or to separate only one of the doctor blades 33 and 34 as long as the pressing force can be suppressed.

Though the above embodiment is provided with two rotational positions, i.e. the first and the second rotational positions, of the cam plate 35, the present invention is not limited to this and three or more rotational positions may be provided. For example, three rotational positions may be provided, and the pressing force at a relatively early stage of the status of use may be suppressed with the doctor blades 33 and 34 being in contact with the surface of the developing roller 31, and the doctor blades 33 and 34 may be separated from the surface of the developing roller 31 after long use, according to information such as the running distance of the developing roller, the cumulative number of revolutions of the developing roller, the number of A4 single prints, the ratio of the running distance of the developing roller to the number of A4 prints or the equivalent of the number of A4 intermission sheets used. Moreover, the pressing force of the doctor blades 33 and 34 may be suppressed in a stepwise fashion. Moreover, the pressing force of the doctor blades 33 and 34 can be suppressed gradually by rotating the cam plate 35 continuously.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A developing device comprising:

a developing roller for developing an electrostatic latent image on a photo conductor;

a developing roller driving unit for rotating the developing roller in a forward direction and in a backward direction respectively while development is performed and not performed;

a thickness regulating member, which is pressed against a surface of the developing roller, for regulating a thickness of developer adhered to the surface of the developing roller; and a suppression unit for suppressing a pressing force of the thickness regulating member when the developing roller is rotated in the backward direction, wherein the thickness regulating member comprises a first thickness regulating plate and a second thickness regulating plate separated from the first thickness regulating plate in an order upstream of a development position, where the electrostatic latent image is developed, in the forward direction and a pressing force of the first thickness regulating plate is larger than a pressing force of the second thickness regulating plate.

2. The developing device according to claim 1, wherein the suppression unit separates the thickness regulating member from the surface of the developing roller.

3. The developing device according to claim 1, wherein the suppression unit comprises a cam-like rotor plate to be in contact with the thickness regulating member, and the thickness regulating member is driven by rotation of the cam-like rotor plate.

4. The developing device according to claim 1, further comprising a splash preventing plate, which is provided upstream of the development position in the forward direction to be in contact with the photo conductor, for preventing splash of developer, wherein the developing roller driving unit rotates the developing roller in the backward direction within a range of a perimeter of the developing roller corresponding to a distance between the development position and a contact position of the splash preventing plate.

5. An image forming apparatus comprising:

a photo conductor for forming an electrostatic latent image;

a developing device described in claim 4 for developing the electrostatic latent image formed on the photo conductor; and an image forming unit for transferring the electrostatic latent image developed by the developing device onto a sheet for completing an image formation.

6. An image forming apparatus comprising:

a photo conductor for forming an electrostatic latent image;

a developing device described in claim 1 for developing the electrostatic latent image formed on the photo conductor; and an image forming unit for transferring the electrostatic latent image developed by the developing device onto a sheet for completing an image formation.

7. The image forming apparatus according to claim 6, further comprising:

an information obtaining unit for obtaining information relating to usage of the developing roller; and a control unit for controlling an amount of rotation of the developing roller in the backward direction based on the information obtained by the information obtaining unit when the developing roller is rotated in the backward direction.

8. The image forming apparatus according to claim 7, further comprising a density information obtaining unit for obtaining information relating to an image formation density, wherein the control unit controls an amount of rotaion of the developing roller in the backward direction based on the information obtained by the density information obtaining unit.

9. The image forming apparatus according to claim 6, further comprising:

an information obtaining unit for obtaining information relating to usage of the developing roller; and a control unit for controlling a frequency of rotation of the developing roller in the backward direction based on the information obtained by the information obtaining unit when the developing roller is rotated in the backward direction.

10. The image forming apparatus according to claim 9, further comprising a density information obtaining unit for obtaining information relating to an image formation density, wherein the control unit controls a frequency of rotation of the developing roller in the backward direction based on the information obtained by the density information obtaining unit.

11. A developing device comprising:

a developing roller for developing an electrostatic latent image on a photo conductor;

a developing roller driving unit for rotating the developing roller in a forward direction and in a backward direction respectively while development is performed and not performed;

a thickness regulating member, which is pressed against a surface of the developing roller, for regulating a thickness of developer adhered to the surface of the developing roller; and a suppression unit for suppressing a pressing force of the thickness regulating member when the developing roller is rotated in the backward direction, wherein the developing roller is rotatable at a plurality of different rotational speeds, and the developing roller driving unit rotates the developing roller in the backward direction at a lowest speed of the rotational speeds.

12. An image forming apparatus comprising:

a photo conductor for forming an electrostatic latent image;

a developing device described in claim 11 for developing the electrostatic latent image formed on the photo conductor; and an image forming unit for transferring the electrostatic latent image developed by the developing device onto a sheet for completing an image formation.

* * * * *